US009296451B2

(12) United States Patent
Toth

(10) Patent No.: US 9,296,451 B2
(45) Date of Patent: Mar. 29, 2016

(54) WEIGHT SYSTEM FOR A BUOYANCY COMPENSATOR

(75) Inventor: Douglas J. Toth, San Clemente, CA (US)

(73) Assignee: ATOMIC AQUATICS, LLC, Salt Lake City, UT (US)

( * ) Notice: Subject to any disclaimer, the term of this patent is extended or adjusted under 35 U.S.C. 154(b) by 0 days.

(21) Appl. No.: 13/313,585

(22) Filed: Dec. 7, 2011

(65) Prior Publication Data

US 2013/0149038 A1 Jun. 13, 2013

(51) Int. Cl.
*B63C 11/30* (2006.01)
*A44B 11/25* (2006.01)

(52) U.S. Cl.
CPC ..... *B63C 11/30* (2013.01); *A44B 11/2592* (2013.01); *B63C 2011/306* (2013.01)

(58) Field of Classification Search
CPC ..... B63C 11/30; B63C 2011/306; B63C 2011/303; B63C 11/2245; A44B 11/2592; A41D 13/0125
USPC ..... 405/185, 186, 187; 24/634, 648, 593.1, 24/650; 114/315, 333; 224/0.5, 221, 934
See application file for complete search history.

(56) References Cited

U.S. PATENT DOCUMENTS

| | | | | |
|---|---|---|---|---|
| 5,205,672 | A | 4/1993 | Stinton | |
| 5,641,247 | A | 6/1997 | Seligman | |
| 5,746,542 | A | 5/1998 | Carmichael | |
| 5,913,640 | A | 6/1999 | Bortner | |
| 5,944,450 | A | 8/1999 | Anderson | |
| 6,030,147 | A | 2/2000 | Bowden | |
| 6,132,142 | A | 10/2000 | Carmichael | |
| 6,463,640 | B1 | 10/2002 | Toth | |
| 6,487,761 | B2 | 12/2002 | Van Tassel | |
| 6,527,479 | B1 | 3/2003 | Courtney et al. | |
| 6,527,480 | B2 | 3/2003 | Angelini et al. | |
| 6,749,370 | B1 | 6/2004 | Urabe et al. | |
| 6,758,635 | B1 | 7/2004 | Feng | |
| 6,966,726 | B2 | 11/2005 | Kawashima | |
| 7,062,790 | B2 | 6/2006 | Rockwell | |
| 7,458,751 | B2 | 12/2008 | Carmichael | |
| 7,540,691 | B2 | 6/2009 | Godoy | |
| 7,874,765 | B2 | 1/2011 | Crow | |
| 2002/0092140 | A1 | 7/2002 | Van Tassel | |
| 2003/0211790 | A1 | 11/2003 | Cressi | |
| 2006/0018718 | A1 | 1/2006 | Angelini et al. | |
| 2009/0136301 | A1 * | 5/2009 | Carmichael | 405/186 |
| 2009/0324340 | A1 | 12/2009 | Crow | |
| 2010/0183373 | A1 * | 7/2010 | Stood et al. | 405/186 |

FOREIGN PATENT DOCUMENTS

WO WO 2012/075512 * 6/2012

* cited by examiner

*Primary Examiner* — Tara M. Pinnock
*Assistant Examiner* — Carib Oquendo
(74) *Attorney, Agent, or Firm* — Austin Rapp & Hardman

(57) ABSTRACT

A weight system for divers employs both an interior and an exterior weight pocket. The interior weight pocket is secured at the interior distal end of the exterior weight pocket. The attachment point is a post at the interior end of the weight pocket. The weight pouch hangs from this post and is secured in the exterior weight pocket. The release force is more precisely controlled with a coil spring. More control of the opening force translates to reliability of operation and safety of the weight releasing mechanism. The weight pouch is also more precisely guided into and out of the exterior weight pocket and the lock mechanism is self-centering, allowing easy assembly or disassembly of the weight pouch into and out of the exterior weight pocket.

13 Claims, 5 Drawing Sheets

WEIGHT SYSTEM FOR A BUOYANCY COMPENSATOR

BACKGROUND OF THE INVENTION

Scuba diving is a growing pastime. During scuba diving, a diver goes underwater and breathes through a breathing unit. While scuba diving, a diver typically wears a jacket with compensating equipment to adjust the effective weight of the diver in the water. This jacket is commonly referred to as "buoyancy compensator" or "BC." More specifically, the BC includes an inflatable bladder (or other similar device) that is inflatable orally or by a container of compressed gas. To rise up in the water, the bladder is filled with air (thus increasing the buoyancy of the diver). When the diver desires to sink in the water, gas is released from the bladder (thereby decreasing the buoyancy of the diver).

In addition to the BC, weights are often used as a means of allowing the diver to sink in the water (or stay submerged at a specific depth). The weights are often disposed in pockets of the BC. In general, the weights are positioned in a "weight pouch." In turn, this weight pouch will be secured within a BC's weight pocket. A diver must be able to release the diving weights quickly when necessary. In underwater emergencies, it is vital that the weights be released rapidly so that the weights may drop away from the diver (and allow the diver to quickly surface to obtain necessary breathing air).

U.S. Pat. No. 6,487,761 to Van Tassel (hereinafter "Van Tassel") provides an example of a "quick release" system that allows weights to be quickly released by the diver in the event of an underwater emergency. (This patent is expressly incorporated herein by reference.) Van Tassel teaches a weight system for a scuba diver which includes a pouch that houses weights. This weight pouch may be attached to the diver's BC. The weight pouch includes a "quick release" buckle on a diver's buoyancy compensator to retain the pouch in a designated pocket. In the event of an emergency, the diver will use the quick release buckle to drop the weight pouch from the BC. In Van Tassel's system, the "prongs" of the buckle that is used to secure the weight pouch may be deformed, thereby allowing the weight pouch to be rapidly released.

Other BC weight systems employ Velcro® flaps as a means of securing a weight pouch within the BC's weight pocket. In these systems, the diver can readily "unhook" the Velcro® and release the weight pouch. However, as the BC is used underwater, the Velcro® tends to lose its holding grip. Accordingly, BCs that use Velcro® flaps are known to wear out over time.

Moreover, some of the known weight systems attach the weight pouch with a buckle. During an emergency, the user must use two hands to unhook the buckle and then drop the weights. Also, if the buckle is positioned in front of the weight pouch, the weight pouch tends to fold over on itself, which causes the weight pouch to fall towards and bunch up near the buckle. This is especially problematic in the swimming position when the buckle is oriented in a downward direction. In this orientation, gravity tends to drop the free end of the weight pouch past the securing buckle. Moreover, diving weights are often small shot-filled bags which tend to change shape to conform to the BC's weight pocket in which they are contained. This makes the weight pouch susceptible to working its way out of the BC's weight pocket, leaving the pouch to hang on to the diver precariously from the weight pouch's attachment point.

Accordingly, there is a need in the art for a new type of weight system that is used with a BC. Such a device is disclosed herein.

BRIEF SUMMARY OF THE INVENTION

The present embodiments relate generally to the field of scuba diving equipment and more specifically to an improved weight system in a buoyancy compensator ("BC"). The weight system comprises an exterior weight pocket on the BC and an interior weight pouch. The weight pouch is designed such that it may be inserted into the BC weight pocket. The weight pouch may be retained in the BC weight pocket by spring-controlled quick-release jaw members that are attached to a post. The post is positioned at the interior (closed) end of the BC weight pocket. The weight pouch hangs from this post. When a diver wants to release the weights, the diver simply pulls the release handle on the weight pouch outward (away from the post). In turn, this pulling force causes the jaw members to open and release their engagement from the post. Accordingly, once the pouch is no longer secured to the post, the diver may quickly remove the pouch from the weight pocket.

The release force necessary to open the jaw members is more precisely controlled with a coil spring. More specifically, this controlling force is more precise than the force applied in other systems (such as a force used to deform a buckle, a force used to separate a Velcro fastener, etc.). More control of the opening force translates to reliability of operation and safety of the weight release.

The weight pouch is also more precisely guided into and out of the weight pocket. In this manner, the insertion of the weight pouch is "self-centering," allowing easy assembly or disassembly of the weight pouch into the BC weight pocket. Ease of assembly is desirable both on land before diving and in the water if the weights need to be removed or readjusted.

BRIEF DESCRIPTION OF THE SEVERAL VIEWS OF THE DRAWINGS

In order that the manner in which the above-recited and other features and advantages of the invention are obtained will be readily understood, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE INVENTION

The presently preferred embodiments of the present invention will be best understood by reference to the drawings, wherein like parts are designated by like numerals throughout. It will be readily understood that the components of the present invention, as generally described and illustrated in the figures herein, could be arranged and designed in a wide variety of different configurations. Thus, the following more detailed description of the present embodiments, as represented in the Figures, is not intended to limit the scope of the invention, as claimed, but is merely representative of presently preferred embodiments of the invention.

Figure 1:
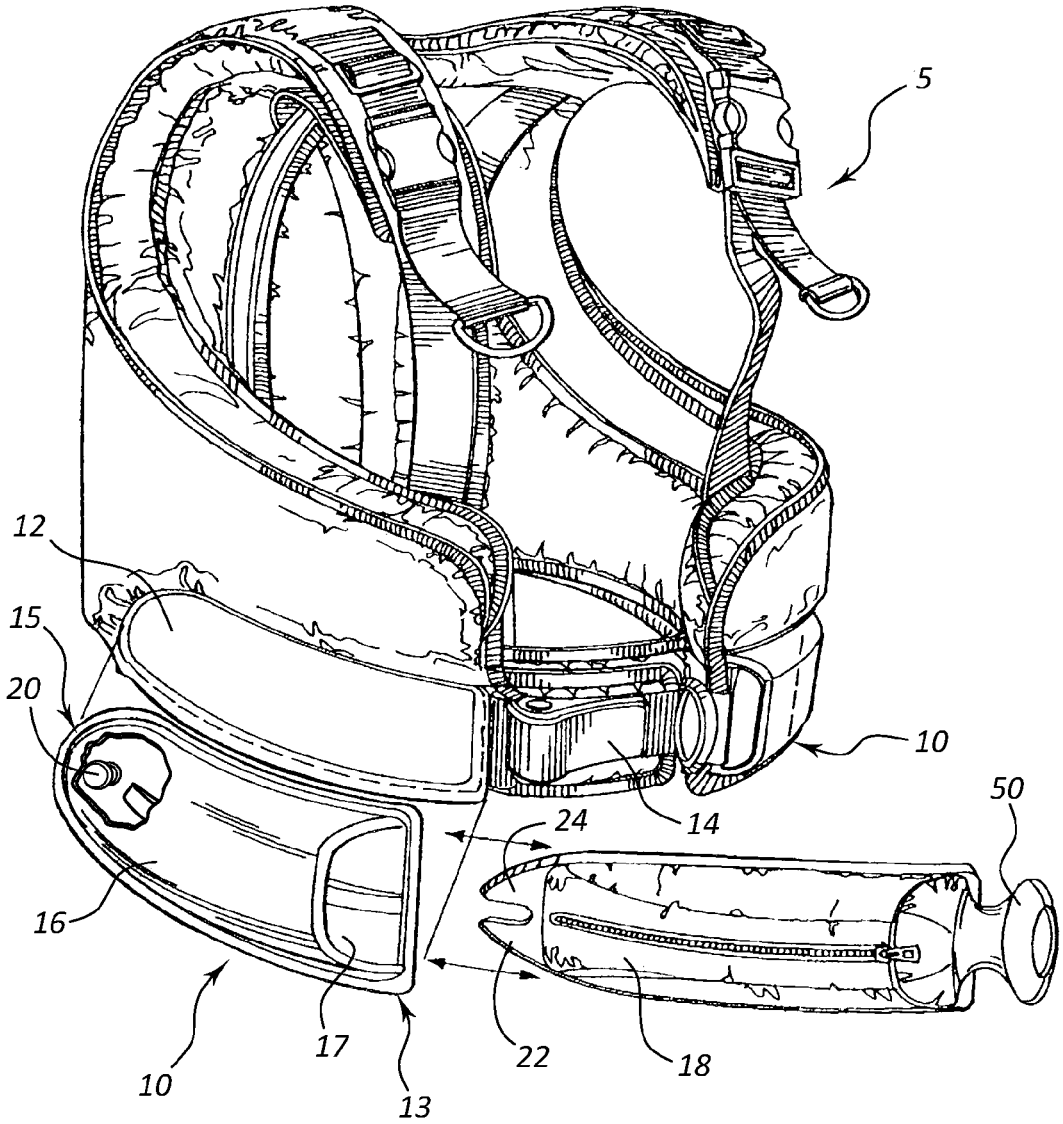
FIG. 1 is a three-dimensional view of a buoyancy compensator having an embodiment of the weight system shown with the interior weight pouch removed from the exterior weight pocket.

Referring now to FIG. 1, a perspective view of a scuba diving vest 5 is illustrated. In some embodiments, the scuba diving vest 5 may be a buoyancy compensator or BC. In other embodiments, the vest 5 may be a weight harness. For clarity of illustration, the present embodiments involve a scuba diving vest 5 that is a buoyancy compensator. Accordingly, the present embodiments may refer to the scuba vest as BC 5. (However, those skilled in the art will appreciate that the vest may be a weight harness).

The BC 5 may include an embodiment of a weight system 10. The weight system 10 may be attached to a vest portion 12 of the BC 5. In fact, two (2) weight system 10 may be attached to the vest portion 12, one weight system 10 used on each side of the BC's waist buckle 14. For purposes of illustration, one of the weight systems 10 is shown fully inserted/connected to the BC 5 (e.g., the weight system on the right side of FIG. 1) whereas the other weight system 10 (e.g., on the left side of FIG. 1) is shown (for purposes of illustration) in its unconnected state.

Each such weight system 10 comprises an exterior weight pocket 16 (which may sometimes be referred to as a receiver 16). This weight pocket 16 shown in FIG. 1 is shown detached from the vest portion 12 of the BC 5. However, this depiction is made for illustrative purposes only. The weight pocket 16 will be sewn or otherwise attached to the vest portion 12. The weight pocket 16 may include a first end 13 and a second end 15. The second end 15 is generally closed. The first end 13 may comprise an opening 17.

The weight system 10 also comprises an interior weight pouch 18. The exterior weight pocket 16 forms a receiver for receiving the interior weight pouch 18. In other words, the weight pouch 18 may be inserted into and removed out of the weight pocket 16 via the opening 17. The weight system 10 may also comprise a post 20 at the rearward interior end of the weight pocket 16. The post 20 may be positioned proximate the closed second end 15. This post 20 may on the vest 12 or may be part of the weight pocket 16 (e.g., on the interior of the pocket 16). The post 20 is designed to secure the interior weight pocket 16 to the BC 5 (in a manner that is described herein).

The interior weight pouch 18 may also include a gripping mechanism 22 which has a spring-biased pair of grippers 24 for engaging the post 20 when the weight pouch 18 has been inserted into the pocket 16 via the opening 17. The gripping mechanism 22 and grippers 24 will be described in greater detail herein in conjunction with FIG. 2.

Figure 2:
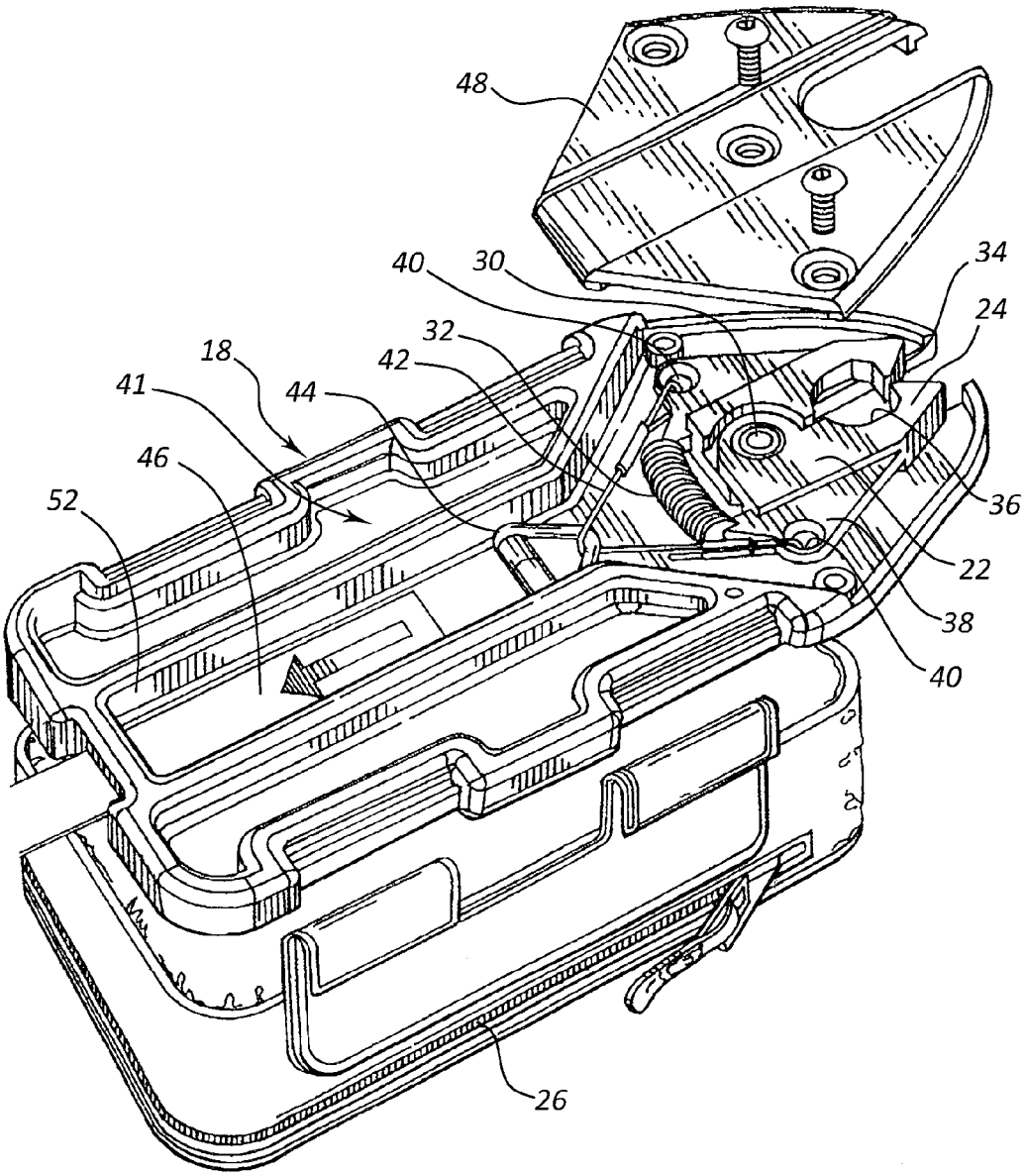
FIG. 2 is an enlarged view of one embodiment of spring-biased jaw members that may be used as part of the weight system.
Figure 4:
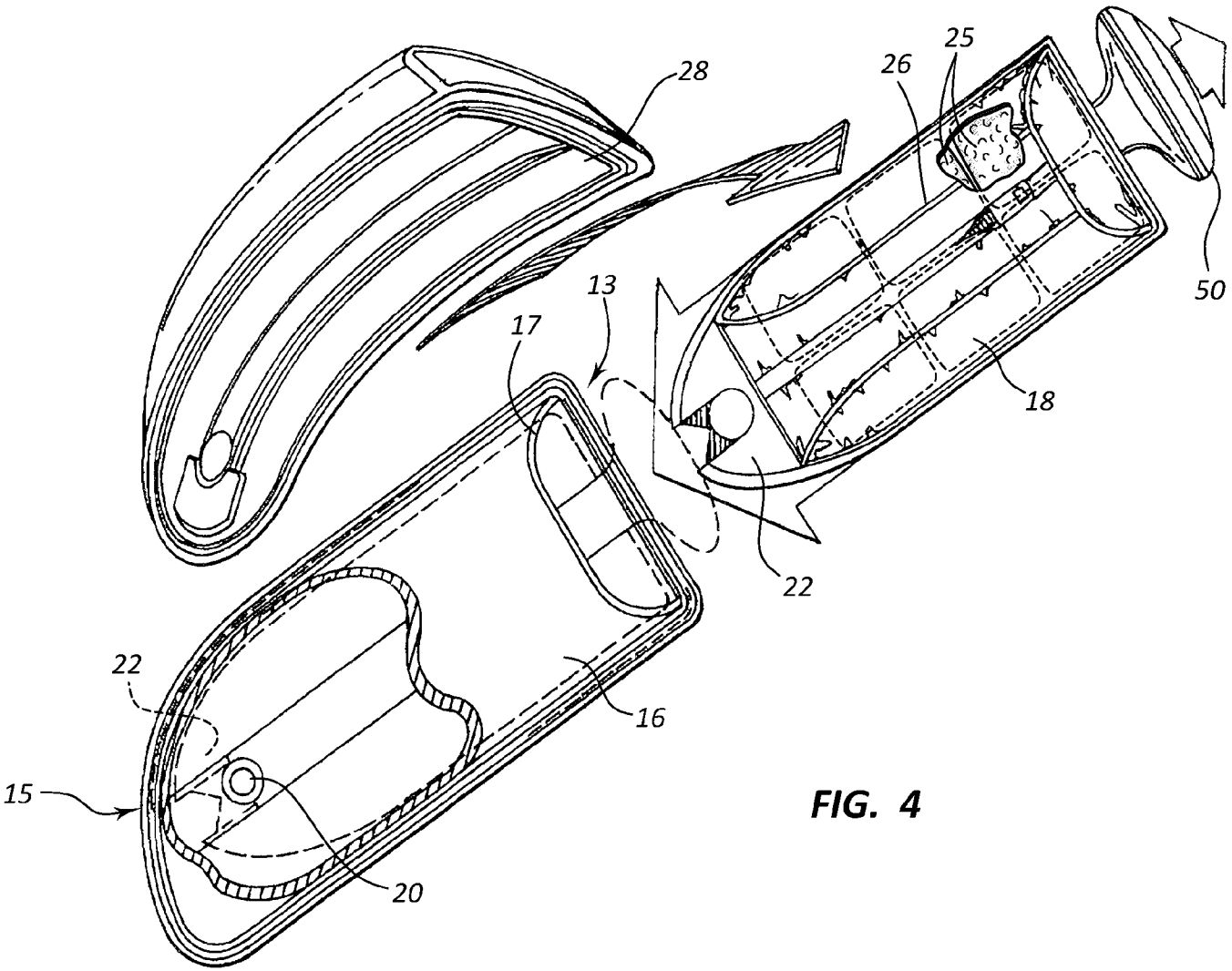
FIG. 4 is an exploded view of the weight pockets according to one embodiment.

In some embodiments, the interior weight pouch 18 may also have a compartment 26 (as best illustrated in FIGS. 2 and 4). In the embodiment shown, the compartment 26 may be sealed via a zipper. However, other ways of closing the compartment 26 may also be used (such as closure via snaps or buttons, closure via Velcro fasteners, closure via a string, etc. Access to this compartment 26 may be available only after the interior weight pouch 18 has been released and removed from the exterior weight pocket 16. The zippered compartment may operate to contain the actual weights 25 (shown in FIG. 4). As known in the industry, these weights may comprise one or more bags of lead shot or the like.

In some embodiments, the inflatable bladder (inflatable portion) of the BC is designed such that there is no inflation behind the weight pocket 16. The purpose of this is to ensure that, during a dive in which the BC 5 is fully or partially inflated, the inflation will not interfere with the removal of the weight pouch 18 from the weight pocket 16. In order to assist in the removal of the weight pouch 18 from the weight pocket 16, a handle 50 may be positioned on the weight pouch 18.

In some embodiments, the back surface 28 (shown in FIG. 4) of the external weight pocket 16 is curved and made of a flexible material to permit the pocket 16 to conform to the corresponding shape of the waist portion of the BC 5. (This curvature is shown best in FIG. 4).

Figure 1A:
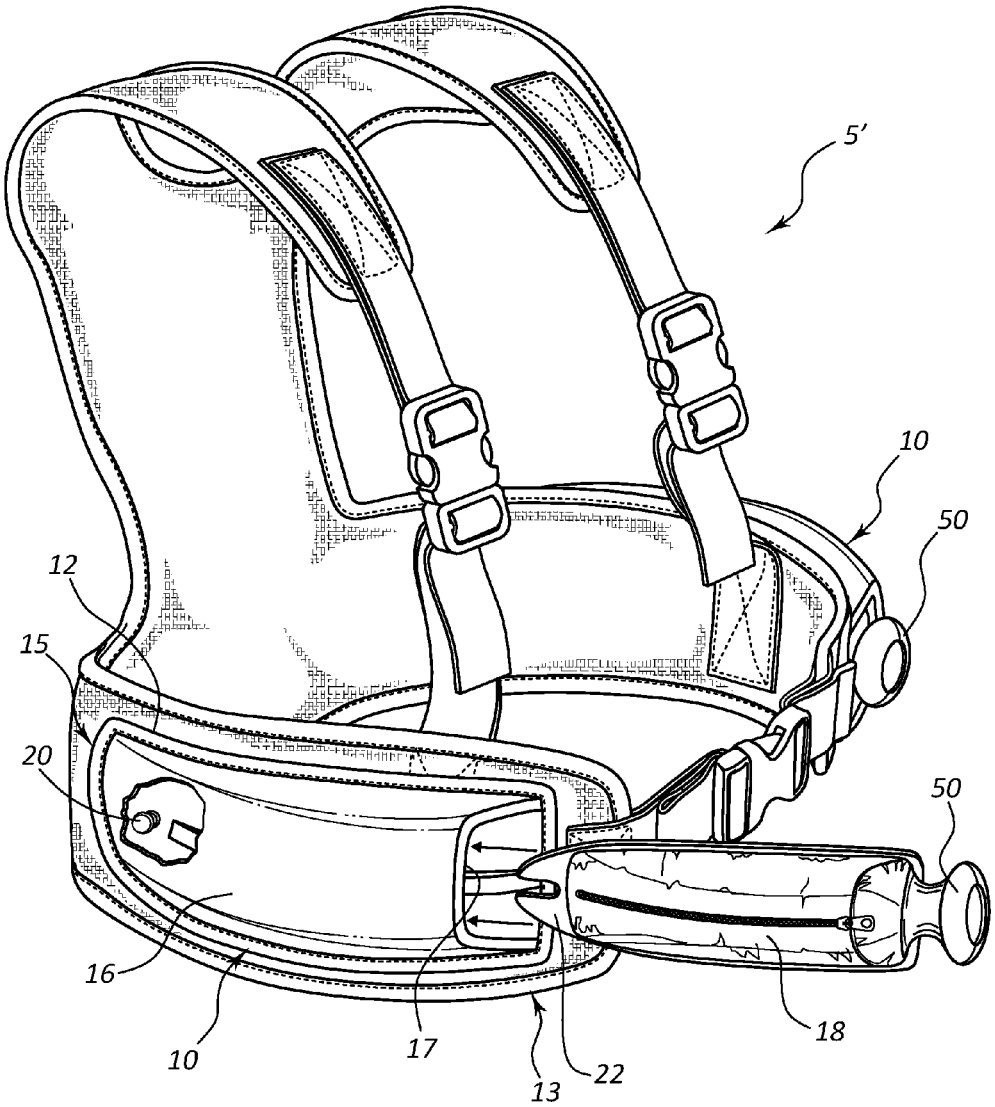
FIG. 1A is a three-dimensional view of a weight harness having an embodiment of the weight system shown with the interior weight pouch removed from the exterior weight pocket.

Referring now to FIG. 1A, an embodiment of a weight harness 5' is illustrated. This weight harness 5' includes a weight system 10 that is similar and/or identical to the weight system 10 described above. As shown in FIG. 1A, there may be two (2) different weight systems 10 added to the weight harness 5', one on each side. Accordingly, as the weight system 10 is similar to that which was described above in FIG. 1, a discussion of the weight system 10 used on the weight harness 5' will be omitted.

Referring now to FIG. 2, an embodiment of the gripping mechanism 22 and grippers 24 are illustrated. More specifically, FIG. 2, shows the structural details of an embodiment of the gripping mechanism 22 that may be positioned proximate the zippered compartment 26.

As seen in FIG. 2, the gripping mechanism 22 may comprise a spring-loaded jaw-type arrangement wherein a pair of mating grippers 24 (which may also be referred to as "jaw members 24") are mounted such that these grippers 24 may have limited rotation about a common unitary axis 30. The jaw members 24 are biased by a spring 32 to be in a locked or gripping position, as shown in FIG. 2. When locked in this gripping position, the respective wedge-shaped leading edges 34 of the grippers 24 engage one another, thereby creating a post-retaining aperture 36. The post 20, shown in FIG. 1, is designed to be enclosed within the aperture 36 when the jaw members 24 are locked in the gripping position via a spring 32. The spring 32 biases the jaw members 24 such that the jaw members 24 are normally held in the closed position (e.g., the position that is capable of retaining/engaging the post 20).

In the embodiment of FIG. 2, each jaw member 24 may have a wing-like flange 38 with a retention hole 40. The spring 32 may also be attached to the flange 38. More specifically, one end of the spring 32 may be attached to one of the retention holes 40 and the opposite end of the spring 32 may be attached to the other retention hole 40. In the embodiment of FIG. 2, opposite ends of a connection member 42 may also be attached to these retention holes 40. In the embodiment of FIG. 2, the connection member 42 is a pull wire (and thus, this element may be referred to as pull wire 42). The pull wire 42 may be secured to a release buckle 44. (In the embodiment of FIG. 2, the pull wire 42 is threaded through the release buckle 44, although other ways of securing the pull wire 42 to the buckle 44 may also be used.) In turn, the release buckle 44 may be attached to a pull release strap 46. Thus, the pull release strap 44 is connected to the pull wire 42 by the buckle 44. The strap 46 may be secured to the handle 50 (shown in FIG. 1).

It should be noted that the pull release strap 46, the buckle 44, the handle 50 and the pull wire 42 may all be components of a pull assembly 41. The operation of the pull assembly 41 will now be described. When the pull assembly 41 is operated, the weight pouch 18 may be released from the pocket 16.

As noted above, the jaw members 24 are normally biased by the spring 32 in the closed position, wherein the post 20

(shown in FIG. 1) fits into the aperture 36. In this configuration, the grippers 24 engage the post 20 and secure the weight pouch 18 within the weight pocket 16.

However, in order to release the grippers 24, the diver simply must pull the strap 46. (Although not shown in FIG. 2, the strap 46 may be secured to the handle 50 of FIG. 1, so that the diver can simply grip the handle 50 and pull the pouch 18 outward from the pocket 16). Pulling the handle 50 and/or the strap 46 away from the post 20 causes the pull wire 42 to move away from the post 20. In turn, this movement of the pull wire 42 pulls the flange 38 and causes mutual opposed rotation of the jaw members 24 around the axis 30. This rotation of the jaw members 24 "opens" post-retaining aperture 36 into an open position such that the post 20 is released from its engagement with the jaw members 24. Once the post 20 is no longer retained by the jaw members 24, the weight pouch 18 may easily be pulled out of the weight pocket 16.

It should be noted that the pulling of the pull assembly 41 also operates to compress the spring 32. (The spring 32 may be compressed by the limited rotation of the jaw members 24.) Upon the diver releasing the strap 46 (or the handle 50), a "pulling" force is no longer being applied to the pull assembly 41. Accordingly, once released, the spring 32 is no longer compressed and the spring 32 biases against the jaw members 24 and causes the jaw members 24 to automatically rotate back into their closed position.

As shown in FIG. 2, a cover plate 48 may be used to secure the jaw members 24, the spring 32, the pull wire 42 within a shaped recess 52. This cover plate 48 protects these components and helps to ensure repeatable operation of a pulling force being applied to the pull mechanism 41.

It should be noted that the wire 42, the handle 50 and the strap 46 are just one embodiment. Other embodiment may be constructed in which there is a strap (such as a molded plastic strap) that connects to the handle 50 and then splits into a "Y-shape" so as to engage both of the attachment holes 40 and/or both ends of the spring. In this embodiment, the connection member 42 would comprise this strap. Those skilled in the art will appreciate that other embodiments may also be made that connect the handle to the spring (and allow the handle to compress the spring upon the addition of the requisite force).

In some embodiments, the spring 32 may be a coil spring. In other embodiments, the spring 32 may be a plastic spring. Coil springs may provide different resistance than plastic springs. In fact, different amounts of force may be required to compress a plastic spring than a coil spring. Those skilled in the art will appreciate that the specific amount of force needed to compress the spring, as well as the specific type of spring, will depend upon the particular embodiment.

Figure 3A:
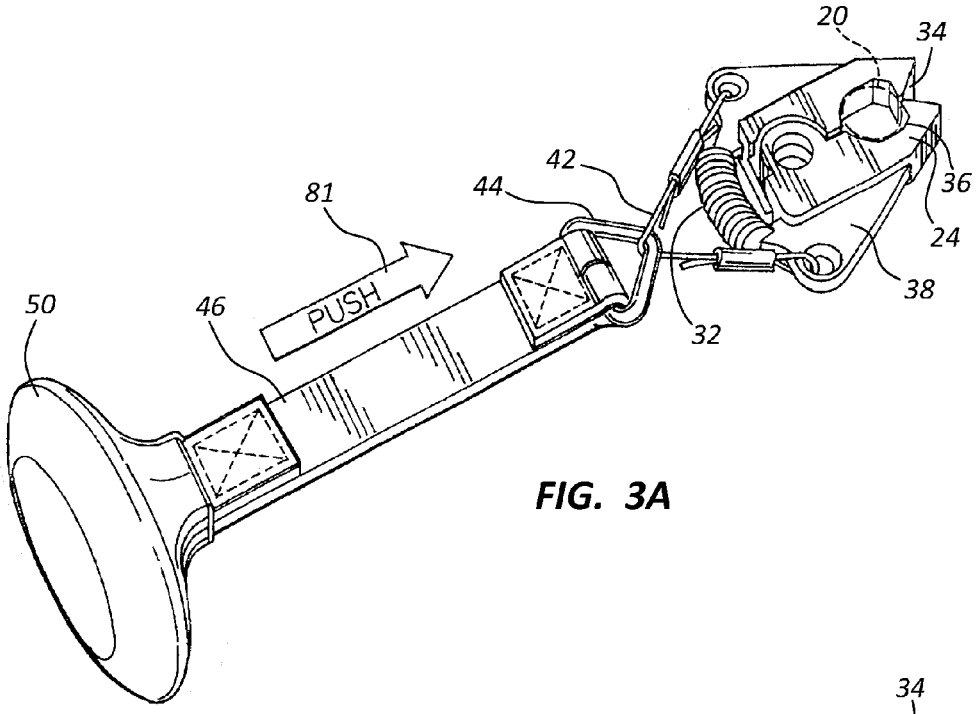
FIGS. 3A and 3B are perspective views that illustrate the operation of one embodiment of the weight system.
Figure 3B:
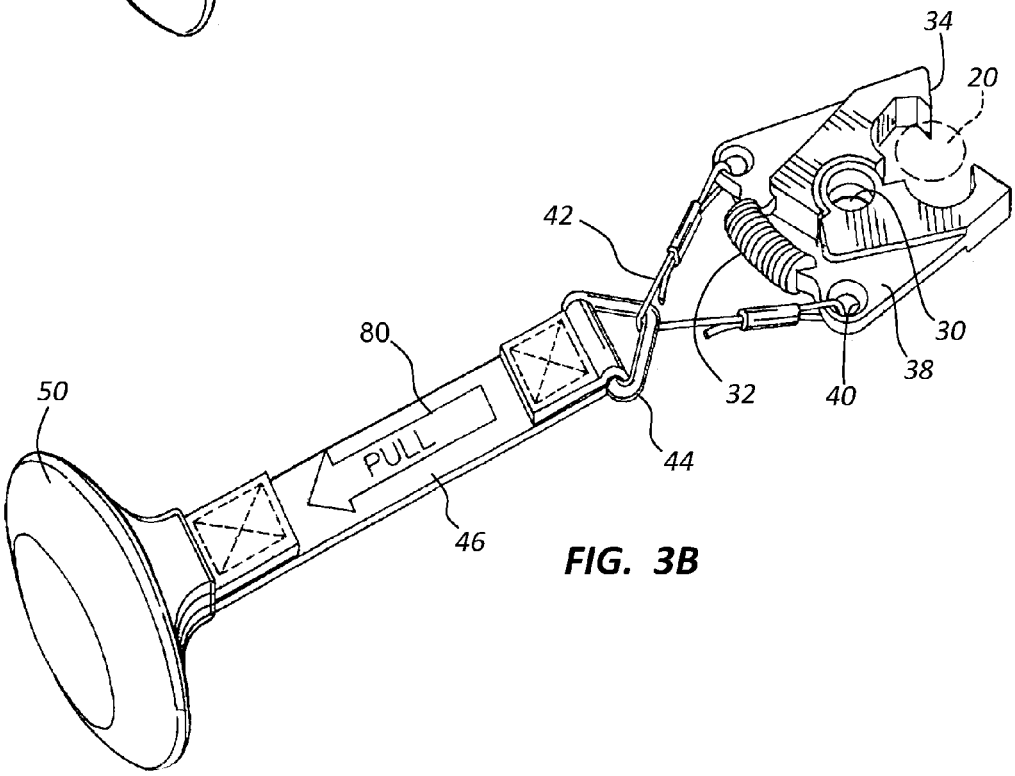

FIGS. 3A and 3B show the way in which the embodiment of FIG. 2 may be operated in relation to the post 20. Specifically, as shown in FIGS. 3A, 3B and 3C, the strap 46 is secured to the handle 50. In FIG. 3A, the strap 46 and the handle 50 are shown being pushed toward the post 20 so that the jaw members 24 are forced to slide around the post 20 and trap it in the aperture 36 between the jaw members 24. Such "pushing" 81 of the strap 46 could occur, for example, when the pouch 18 is being inserted into the pocket 16. (The remaining structure of the interior weight pouch (not shown in FIG. 3A) would of course be needed to apply sufficient force to open the jaw members 24 to allow them to surround/enclose the post 20.)

FIG. 3B shows a pulling force 80 being applied to the strap 46 and the handle 50. This pulling force 80 may be applied when the diver desires to remove the pouch 18 from the pocket 16. This pulling force 80 operates to compress the spring 32 and separate the jaw members 24. Such compression of the spring 32 opens the aperture 36 so that the jaw members 24 can be separated from the post 20. Such separation of the jaw members 24 from the post 20 ends the engagement between the jaw members 24 and the post 20 and allows the diver to pull the weight pouch 18 out from the weight pocket 16.

FIG. 4 shows an assembly view of the weight pouch 18 and the weight pocket 16. Specifically, FIG. 4 shows the weight pouch 18 and the weight pocket 16 ready for engagement or just after removal of the interior weight pouch 18 from the exterior pocket 16.

Referring now to all of the Figures collectively, there are significant advantages associated with the use of the present weight system. For example, as the weight pouch 18 can readily be removed by simply pulling the handle 50 (and thus releasing the jaw members 24), the weight pouch 18 can consistently and reliably be removed (dropped) during a dive, even if the weight pocket 16 is full of sand, debris, etc. Moreover, as the jaw members 24 are positioned proximate the closed second end 15, the jaw members 24 are protected from being interfered with by sand or other debris. In this regard, the positioning of the cover plate 48 may also help to protect the jaw members 24. (In Van Tassel's system, the weight pouch is secured by a deformable buckle; however, during a dive, sand or debris can interfere with the operation of the prongs of the buckle. Such a problem does not exist in the present embodiments.)

It should be noted that the present embodiments have been shown with respect to a BC 5. However, other embodiments may be designed in which the weight system 10 is used with respect to a weight harness or other scuba diving vest.

As explained herein, the use of the weight system 10 provides for a reliable release of the weight pouch 18 from the pocket 16. It should also be noted that the present embodiments also allow for consistent insertion of the weight pouch 18 into the pocket 16. When the pouch 18 is inserted into the pocket 16, the jaw members 24 will contact the post 20 and will be opened and closed around the post, thereby securing the pouch 18 to the pocket 16. However, the insertion of the weight pouch 18 is "self-centering," meaning that the diver will quickly know whether jaw members 24 have engaged the post 20. Further, engagement between the jaw members 24 and the post 20 operates to center the pouch 18 within the pocket 16. Moreover, the leading edges 34 of the jaw members 24 are shaped to center the post 20 within the aperture 36. Accordingly, the present design allows for easy assembly or disassembly of the weight pouch into the BC weight pocket.

The present invention may be embodied in other specific forms without departing from its structures, methods, or other essential characteristics as broadly described herein and claimed hereinafter. The described embodiments are to be considered in all respects only as illustrative, and not restrictive. The scope of the invention is, therefore, indicated by the appended claims, rather than by the foregoing description. All changes that come within the meaning and range of equivalency of the claims are to be embraced within their scope.

The invention claimed is:

1. A weight system for a buoyancy compensator or a weight harness, the weight system comprising:

a weight pocket affixed to the buoyancy compensator or the weight harness, the weight pocket having a first end, a second end and a length, wherein an opening is disposed at the first end and a post is proximate the second end, wherein the post protrudes from an inner surface of the weight pocket in a direction perpendicular to the length of the weight pocket; and a weight pouch configured to house at least one weight, the weight pouch having a gripping mechanism disposed at a first end of the weight pouch and a release mechanism disposed at a second end of the weight pouch, the weight pouch being configured for releasable attachment to the post upon insertion of the weight pouch into the weight pocket through the first end opening.

2. The weight system recited in claim 1 wherein:

the gripping mechanism comprises a pair of opposed jaw members that both rotate about a common axis; and when the jaw members are in a closed position, the jaw members engage one another to form an enclosed aperture to receive the post for locking the weight pouch to the weight pocket.

3. The weight system recited in claim 2 wherein the jaw members are tapered to move in opposite directions around said post, wherein this movement releases the post from the enclosed aperture, the jaw members being held in a normally closed position by a spring.

4. The weight system recited in claim 3 further comprising a pull assembly for compressing the spring to separate the jaw members to release the post from the enclosed aperture and separate the weight pouch from the weight pocket.

5. The weight system recited in claim 4 wherein the pull assembly comprises:

a pull wire attached to the jaw members and to opposed ends of the spring; and a handle, whereby pulling the handle also pulls the pull wire and compresses the spring, wherein the pulling of the handle causes the pull wire to move away from the post, and wherein this movement of the pull wire causes the jaw members to separate.

6. The weight system of claim 1, wherein the second end of the weight pocket is closed.

7. The weight system of claim 1, wherein:

the gripping mechanism comprises a first jaw member, a second jaw member, a spring and a pull assembly;

the first jaw member comprises a first flange with a first retention hole;

the second jaw member comprises a second flange with a second retention hole;

a first end of the spring is attached to the first retention hole and a second end of the spring is attached to the second retention hole;

the pull assembly comprises a connection member, a release buckle and a pull release strap;

a first end of the connection member is attached to the first retention hole and a second end of the connection member is attached to the second retention hole;

the connection member is secured to the release buckle; and the release buckle is attached to the pull release strap.

8. A weight system for a scuba diving vest or weight harness, the weight system comprising:

a pocket having an opening at a first end, a post at a second end and a length, wherein the post protrudes from an inner surface of the pocket in a direction perpendicular to the length of the pocket; and a weight pouch configured to house at least one weight and a pair of opposed jaw members disposed at a first end of the weight pouch, the pair of opposed jaw members for engaging the post in releasable engagement when the pouch is placed into the pocket through the opening, the weight pouch further having a release mechanism disposed at a second end of the weight pouch.

9. The weight system recited in claim 8 further comprising a spring, wherein the spring biases the jaw members to remain normally in a closed position and wherein each of the jaw members has a wedge-shaped leading edge that engage one another when the jaw members are in the closed position.

10. The weight system recited in claim 9 wherein the weight pouch comprises a pull assembly for opening the jaw members, wherein opening the jaw members releases the engagement between the jaw members and the post and allows the weight pouch to be removed from the pocket.

11. The weight system recited in claim 10 wherein the pull assembly comprises a pull wire for compressing the spring.

12. The weight system recited in claim 11 wherein the pull assembly comprises a strap attached to the pull wire.

13. The weight system of claim 8, wherein the second end of the pocket is closed.

* * * * *